US006093037A

United States Patent [19]

Lin

[11] Patent Number: 6,093,037

[45] Date of Patent: Jul. 25, 2000

[54] TRACK AND CONNECTOR ARRANGEMENT

[76] Inventor: Shan Chaing Lin, No. 2, Lane 111, Ta Chu Road, Lu Chu Hsiang, Taoyuan Hsien, Taiwan

[21] Appl. No.: 09/239,204

[22] Filed: Jan. 28, 1999

[51] Int. Cl.[7] ..... H01R 25/00

[52] U.S. Cl. ..... 439/115

[58] Field of Search ..... 439/115, 210, 439/213, 723, 724

[56] References Cited

U.S. PATENT DOCUMENTS

| | | | |
|---|---|---|---|
| 3,622,938 | 11/1971 | Ito et al. | 439/115 |
| 4,089,578 | 5/1978 | Valtonen | 439/115 |
| 4,245,874 | 1/1981 | Bishop | 439/115 |
| 5,336,100 | 8/1994 | Gabrius et al. | 439/115 |

*Primary Examiner*—Gary F. Paumen
*Attorney, Agent, or Firm*—Dougherty & Troxell

[57] ABSTRACT

A track and connector arrangement in which the track (1) includes a metal casing (1), an insulator strip (12) mounted inside the casing (1) and having two opposed inside flanges (123), and two metal conducting strips (13) bilaterally mounted within the insulator strip (12) between the inside flanges (123) and flat top wall (121) of the insulator strip (12); the connector (2) includes a shell (21) longitudinally abutted against one end of the metal casing (11) of the track (1), a terminal holder (22) securely mounted on the shell (21), the terminal holder (22) having a protruding portion (2213) plugged into a positioning space (14) between bottom walls (113) of the metal casing (11) and inside flanges (123) of the insulator body (12), and two electric terminals (222) longitudinally bilaterally mounted on the terminal holder (22), the electric terminals (222) each having a curved springy contact portion (2222) at one end respectively pressed on the metal conducting strips (13) in the insulator strip (12) inside the metal casing (11) to conduct electricity.

3 Claims, 4 Drawing Sheets

TRACK AND CONNECTOR ARRANGEMENT

BACKGROUND OF THE INVENTION

The present invention relates to tracks for hanging light fixtures, and connector for connection between two tracks for transmission of electricity.

U.S. Pat. No. 5,336,100, entitled "Connector for track", teaches the connection of a connector to a pair of spaced conductive wires in tracks, in which base has a pair of connector belts for the insertion of wires in respective apertures, and set screws are mounted in the connector belts for securing the wires in place. Because wires must be maintained extended out of the tracks at a distance, it is inconvenient to cut a track to the desired length with the respective wires maintained extended out of the ends of the cut track at the desired distance. Further, because the track uses insulator body to cover the electric wires, its bending strength is low. When a big number of light fixtures are hung on the track, the track tends to be forced to deform.

SUMMARY OF THE INVENTION

The present invention has been accomplished to provide a track and connector arrangement which eliminates the aforesaid problems. It is one object of the present invention to provide a track for light fixtures which has high bending strength. It is another object of the present invention to provide a track and connector arrangement which keeps electric wires received within the track. According to one embodiment of the present invention, the track and connector arrangement comprises a track for hanging light fixtures, and a connector electrically connected to a pair of spaced metal conducting strips in an insulator strip inside the track. The track comprises a metal casing, an insulator strip mounted inside the casing and having two opposed inside flanges, and two metal conducting strips bilaterally mounted within the insulator strip between the inside flanges and flat top wall of the insulator strip. The connector comprises a shell longitudinally abutted against one end of the metal casing of the track, a terminal holder securely mounted on the shell, the terminal holder having a protruding portion plugged into a positioning space between bottom walls of the metal casing and inside flanges of the insulator body, and two electric terminals longitudinally bilaterally mounted on the terminal holder. The electric terminals each have a curved springy contact portion at one end respectively pressed on the metal conducting strips in the insulator strip inside the metal casing to conduct electricity.

DETAILED DESCRIPTION OF THE PREFERRED EMBODIMENT

Figure 1:
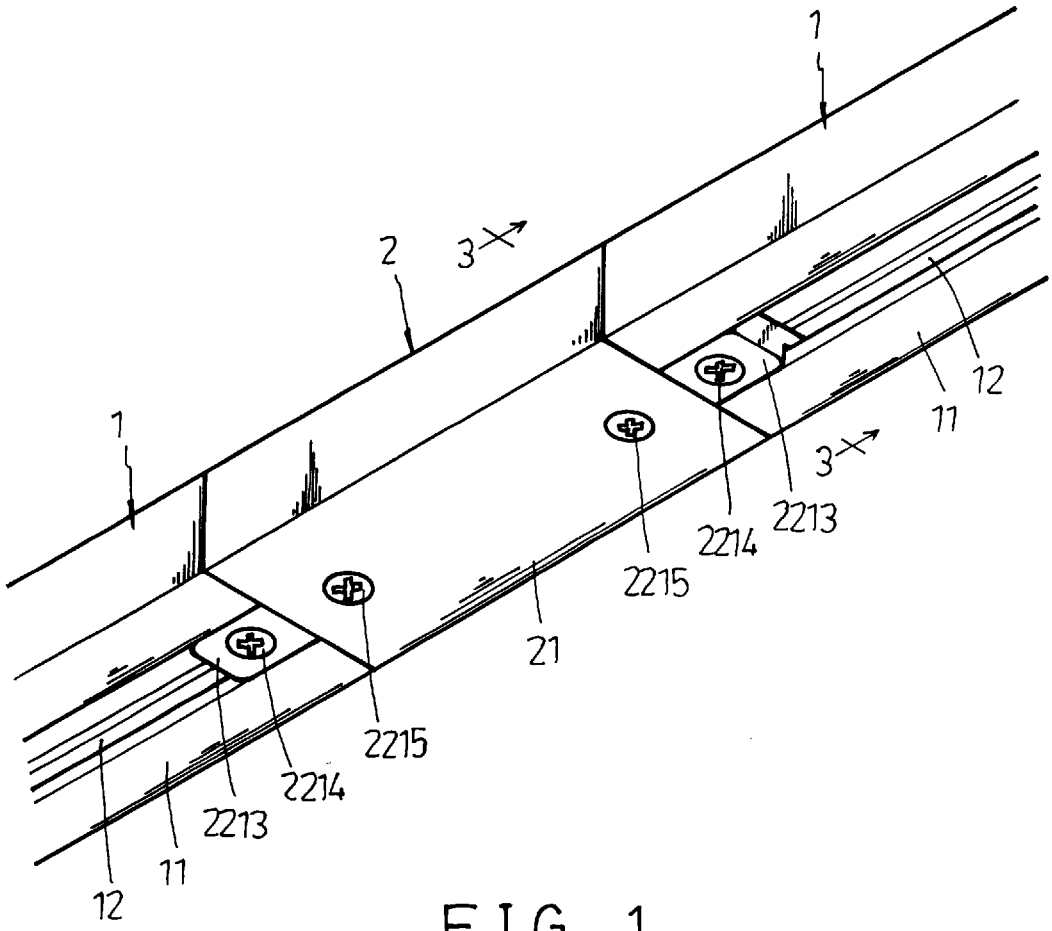
FIG. 1 is a perspective view of a track and connector arrangement according to a first embodiment of the present invention.
Figure 2:
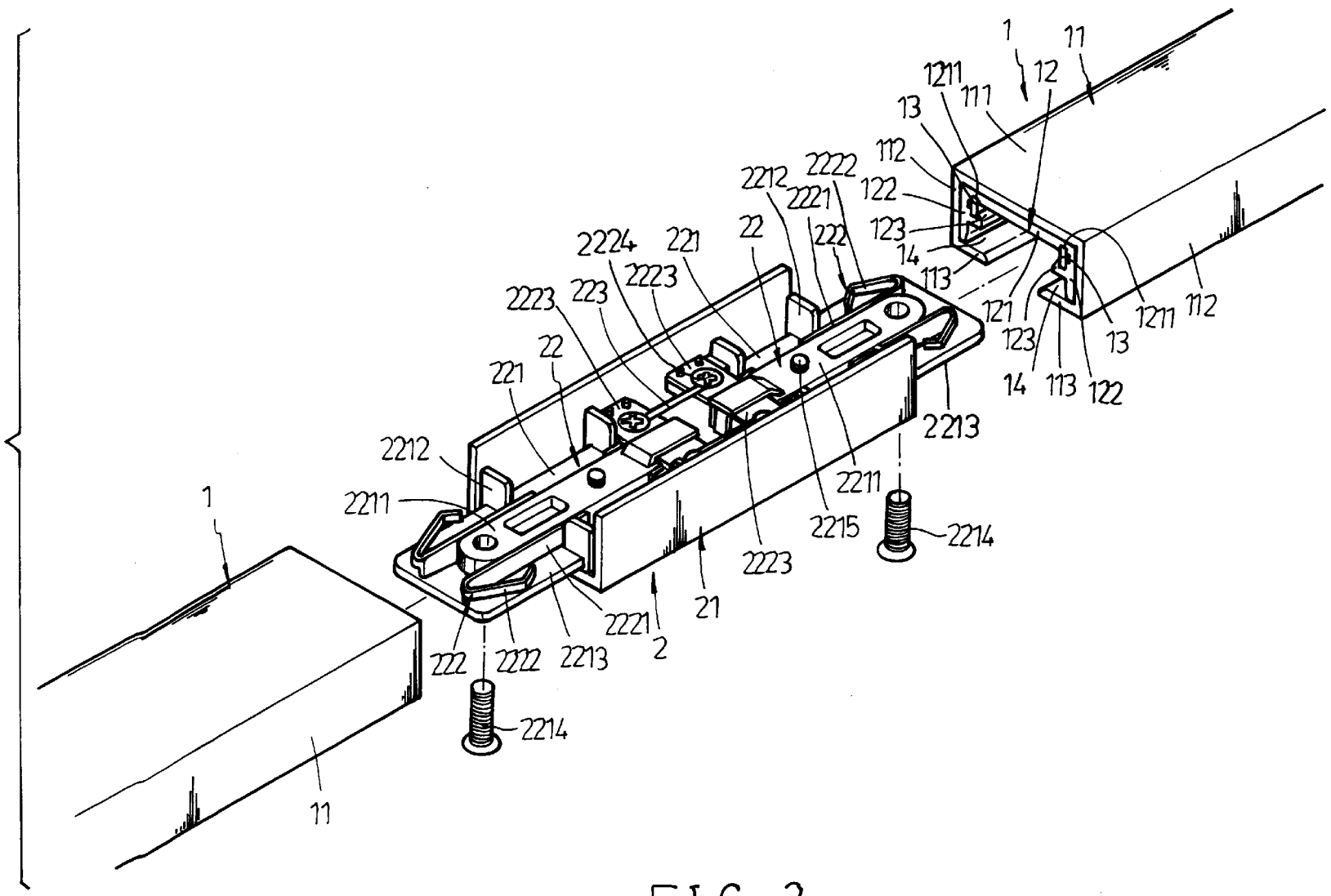
FIG. 2 is an exploded view of the track and connector arrangement shown in FIG. 1.

Referring to FIGS. 1 and 2, a track and connector arrangement according to the present invention comprises track 1 for hanging light fixtures, and connector 2 for connection between tracks 1 for transmission of electricity.

Figure 3:
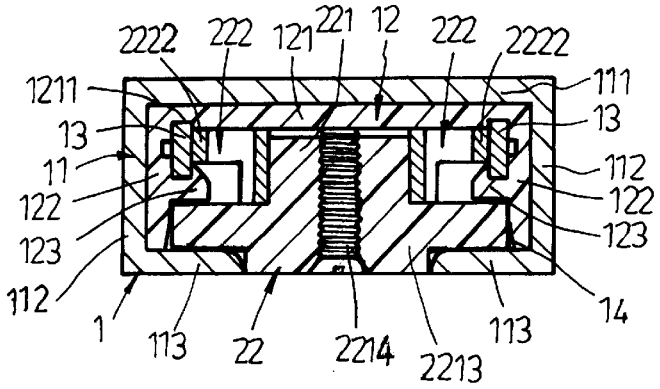
FIG. 3 is a sectional view taken along line 3—3 of FIG. 1 in an enlarged scale.

Referring to FIGS. 2 and 3, the track 1 comprises an elongated metal casing 11, an insulator strip 12, and two metal conducting strips 13. The metal casing 11 comprises a flap top wall 111, two vertical side walls 112 perpendicularly downwardly extended along two opposite lateral sides of the flap top wall 111, and two bottom walls 113 perpendicularly inwardly extended from the side walls 112 at a bottom side toward each other and spaced from each other at a gap and arranged in parallel to the flat top wall 111. The insulator strip 12 is inserted into the casing 11, having a flat top wall 121 closely attached to the flat top wall 111 of the casing 11 on the inside, two vertical side walls 122 respectively closely attached to the vertical side walls 112 of the casing 11 on the inside, and two inside flanges 123 respectively perpendicularly raised from the vertical side walls 122 toward each other and respectively spaced between the flat top wall 111 and bottom walls 113 of the casing 11. After installation of the insulator strip 12 in the casing 11, the inside flanges 123 of the insulator strip 12 define with the bottom walls 113 of the casing 11 a positioning space 14. The metal conducting strips 13 are bilaterally inserted into the insulator strip 12 within the casing 11, and respectively retained between the flat top wall 121 and the inside flanges 123. The flat top wall 121 of the insulator strip 12 has two longitudinally extended locating grooves 1211 for the positioning of the metal conducting strips 13. Because the metal conducting strips 13 are respectively engaged into the locating grooves 1211 and retained between the flat top wall 121 and the inside flanges 123 inside the insulator strip 12, they are well insulated from the metal casing 11. Because the casing 11 is made of metal, it has high bending strength sufficient for holding a big number of light fixtures.

Figure 4:
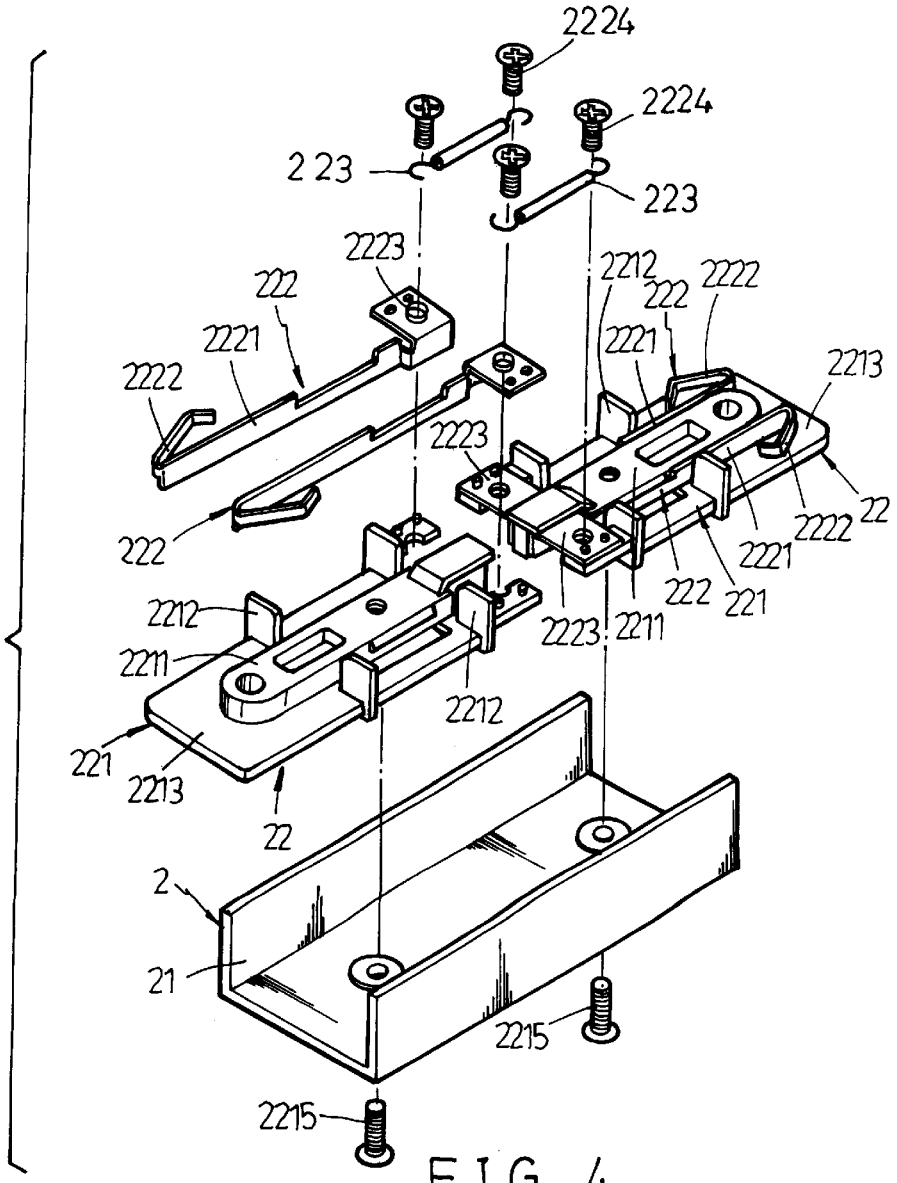
FIG. 4 is an exploded view of the connector used in the track and connector arrangement according to the first embodiment of the present invention.
Figure 5:
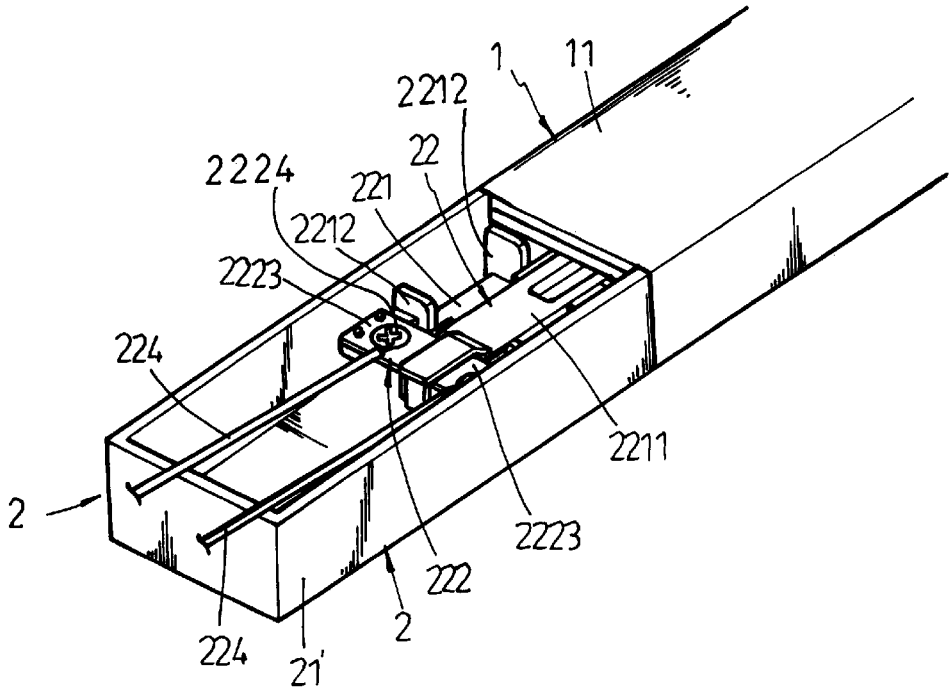
FIG. 5 is a perspective view of a track and connector arrangement according to a second embodiment of the present invention.

Referring to FIGS. 4 and 5 and FIGS. 2 and 3 again, the connector 2 comprises a shell 21, and at least one connecting unit 22. In the first embodiment shown in FIGS. 2 and 4, the connector 2 is comprised of a shell 21, and two connecting units 22. In the second embodiment shown in FIG. 5, the connector 2 is comprised of a shell 21', and one connecting unit 22. The connecting unit 22 comprises a terminal holder 221, and two electric terminals 222. The terminal holder 221 is fixedly fastened to the shell 21 or 21' on the inside by screws 2215, comprising a longitudinally extended partition block 2211 at its top side, two sets of side frames 2212 spaced from two opposite lateral sides of the partition block 2211, and a protruding portion 2213 extended out of one end of the shell 21 or 21'. The electric terminals 222 are respectively mounted in the terminal holder 221 and bilaterally set between the partition blocks 2211 and the side frames 2212, each comprising an elongated terminal body 2221, a curved springy contact portion 2222 extended from one end of the elongated terminal body 2221 and supported on the protruding portion 2213 of the terminal holder 221, and a mounting portion 2223 extended from an opposite end of the elongated terminal body 2221. The curved springy contact portion 2222 has a substantially V-shaped profile obliquely backwardly extended from one end of the elongated terminal body 2221. In the first embodiment shown in FIGS. 2 and 4, the mounting portions 2223 of the electric terminals 222 at one connecting unit 22 are respectively connected to the mounting portions 223 of the electric terminals 222 at the other connecting unit 22 by conductors 223, which are respectively fastened to the mounting portions 2223 of the electric terminals 222 by tie screws 224. In the second embodiment shown in FIG. 5, electric wires 224 are respectively fastened to the mounting portions 2223 of the electric terminals 222 by tie screws 2224 for guiding electricity to the electric terminals 222.

Referring to FIGS. 1 and 3, when connecting one connector 2 to one end of one track 1, the protruding portion 2213 of one connecting unit 22 of the connector 2 is inserted into the positioning space 14 at one end of the track 1, and then secured in place by holding down screws 2214, enabling the curved springy contact portions 2222 of the electric terminals 222 to be respectively pressed on the metal conducting strips 13 inside the insulator strip 12. When installed, the shell 21 of the connector 2 is longitudinally abutted against one end of the track 1, and maintained in flush with the metal casing 11 of the track 1.

Figure 6:
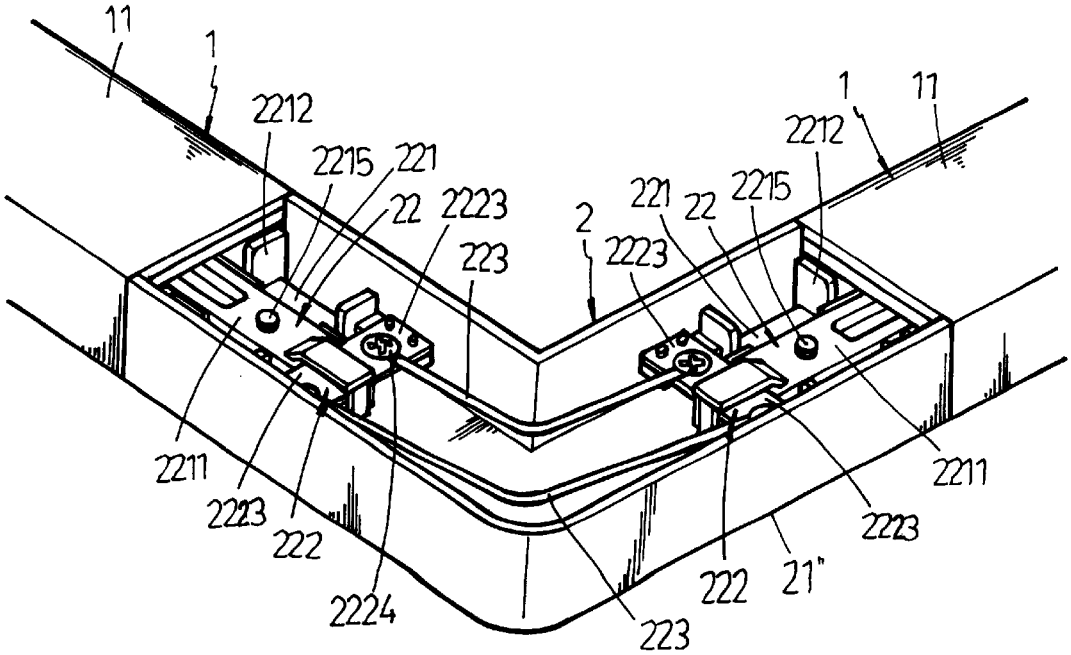
FIG. 6 is a perspective view of a track and connector arrangement according to a third embodiment of the present invention.

FIG. 6 shows a track and connector arrangement according to a third embodiment of the present invention. According to this embodiment, the shell 21" of the connector 2 has a L-shaped profile for connecting two tracks 1 at right angles.

It is to be understood that the drawings are designed for purposes of illustration only, and are not intended as a definition of the limits and scope of the invention disclosed.

What the invention claimed is:

1. A track and connector arrangement comprising:

a track (1) for hanging light fixtures, said track (1) comprising an elongated metal casing (11), an insulator strip (12) mounted within said metal casing (11), and two metal conducting strips (13) bilaterally mounted within said insulator strip (12) and insulated from said metal casing (11) by said insulator strip (12), said metal casing (11) comprising a flap top wall (111), two separated bottom walls (113), and two vertical side walls (112) bilaterally connected between said flap top wall (111) and the bottom walls (113), said insulator strip (12) having a flat top wall (121) closely attached to the flat top wall (111) of said metal casing (11) on the inside thereof, two vertical side walls (122) respectively closely attached to the vertical side walls (112) of said casing (11) on the inside thereof, and two inside flanges (123) respectively perpendicularly raised from the vertical side walls (122) of said insulator strip (12) toward each other and respectively spaced between the flat top wall (111) and bottom walls (113) of said metal casing (11), the inside flanges (123) of said insulator strip (12) defining with the bottom walls (113) of said metal casing (11) a positioning space (14), said metal conducting strips (13) being bilaterally inserted into said insulator strip (12) within said metal casing (11) and respectively retained between the flat top wall (121) and inside flanges (123) of said insulator strip (12); and a connector (2) securely mounted on one end of said track (1), said connector (2) comprising a shell (21) longitudinally abutted against one end of said track (1), and at least one connecting unit (22), said at least one connecting unit (22) comprising a terminal holder (221) fixedly fastened to said shell (21) by screw means and two electric terminals (222) mounted on said terminal holder (221), said terminal holder (221) comprising a longitudinally extended partition block (2211), two sets of side frames (2212) spaced from two opposite lateral sides of said partition block (2211), and a protruding portion (2213) extending out of one end of said shell (21) and adapted for plugging into the positioning space (14) at one end of said track (1), said electric terminals (222) being respectively mounted in said terminal holder (221) and bilaterally set between said partition blocks (2211) and said side frames (2212), said electric terminals each comprising an elongated terminal body (2221), a curved springy contact portion (2222) extending from one end of said elongated terminal body (2221) and supported on the protruding portion (2213) of said terminal holder (221) for contacting one metal conducting strip (13) in said track (1), and a mounting portion (2223) extending from an opposite end of said elongated terminal body (2221) for connection to a power source.

2. The track and connector arrangement of claim 1 wherein the flat top wall (121) of said insulator strip (12) comprises two longitudinally extended locating grooves (1211) for the positioning of said metal conducting strips (13).

3. The track and connector arrangement of claim 1 wherein each curved springy contact portion (2222) has a substantially V-shaped profile obliquely backwardly extending from one end of the elongated terminal body (2221) of the respective electric terminal (222).

* * * * *